US005255831A

United States Patent [19]

Bellamy

[11] Patent Number: 5,255,831

[45] Date of Patent: Oct. 26, 1993

[54] APPARATUS FOR DISPLAY OF BRIDAL GOWN TRAINS

[76] Inventor: Marion K. Bellamy, 2273 Banbury La., Rock Hill, S.C. 29732

[21] Appl. No.: 970,864

[22] Filed: Nov. 3, 1992

[51] Int. Cl.[5] ..... A47G 25/16

[52] U.S. Cl. ..... 223/88; 223/85

[58] Field of Search ..... 223/85, 88, 92, DIG. 4; 211/113; D6/315, 328

[56] References Cited

U.S. PATENT DOCUMENTS

| | | | |
|---|---|---|---|
| 2,058,217 | 10/1936 | Dixon | 223/85 |
| 2,191,714 | 2/1940 | Gustin | 223/85 |
| 2,645,357 | 7/1953 | Taylor | 211/119 |
| 2,771,654 | 11/1956 | Moore | 223/DIG. 4 |
| 3,180,544 | 4/1964 | Magiera | 223/92 |
| 4,364,496 | 12/1982 | Bridgeman | 223/92 |
| 4,739,911 | 4/1988 | Quinn | 223/85 |
| 4,921,098 | 5/1990 | Combier et al. | 223/92 |

FOREIGN PATENT DOCUMENTS

| | | | |
|---|---|---|---|
| 1423902 | 2/1976 | United Kingdom | 223/85 |

*Primary Examiner*—Clifford D. Crowder
*Assistant Examiner*—Bibhu Mohanty

[57] ABSTRACT

Apparatus for the display of bridal gown trains, while still in the garment bag without covering the bodice portion of the gown or wrinkling the train of the gown. In both embodiments a horizontal bar is provided to hold the bridal train for display.

1 Claim, 1 Drawing Sheet

APPARATUS FOR DISPLAY OF BRIDAL GOWN TRAINS

BACKGROUND OF THE INVENTION

The present invention relates generally to a device used to conveniently display bridal gowns in a retail environment to enhance their sales appeal and reduce handling of the garment.

The standard storage and display method for bridal gowns in a retail store is to hang the gowns on standard dress hangers inside large, clear garment bags. This results in the trains of the gowns being wadded in the bottom of the bag. This wrinkles the trains and makes it difficult to store many garments together in a reasonable space within a limited retail area, since the large size of the trains at the bottom of the garment bags forces the gowns to be spread apart. To help overcome this problem, store managers will often pull the train from the bottom of the bag and hook it on the gown dress hanger. When this is done, the back of the bodice of the gown is covered and the train is still displayed in a rumpled manner.

It is accordingly an objective of the present invention to provide an apparatus for the improved display of bridal gowns which avoids the disadvantages of the prior methods. It is a specific objective of the present invention to provide an apparatus, which allows the train of a bridal gown to be displayed aesthetically in the garment bag without covering either the front or back of the bodice of the garment and to avoid wadding of the train in the bottom of the bag.

DESCRIPTION OF THE PREFERRED EMBODIMENTS

Figure 1:
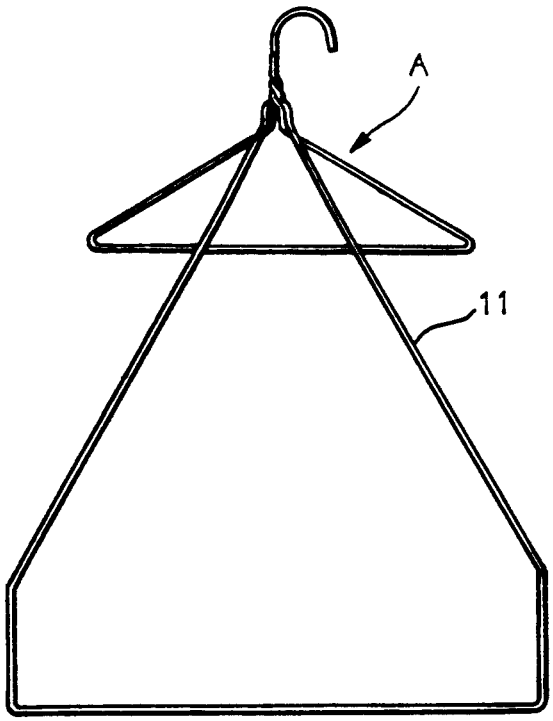
FIG. 1 shows a frontal view of one embodiment of the invention.
Figure 2:
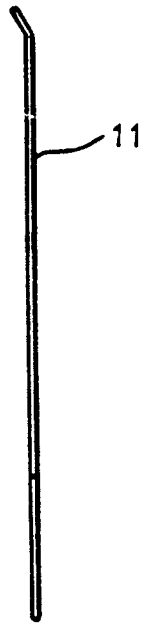
FIG. 2 shows a side view of the embodiment of FIG. 1.

Referring now to the accompanying drawings and initially to FIG. 1, a steel wire 11 with a one-eighth inch diameter was bent into the shape shown and the two ends welded to make a continuous loop hanger. The top portion of the hanger was bent 30 degrees, as shown in the side view FIG. 2, according to the preferred embodiment of the present invention. The width of the hanger is the same as the width of a garment bag to provide maximum length for display of the bridal train and to hold apart the sides of the garment bag. The top of the bridal gown train holder fits over the regular dress hanger on which the bridal gown is hung. The wedding gown train is then pulled up over the lower bar of the holder and draped so that the train may be viewed inside the bag.

Figure 3:
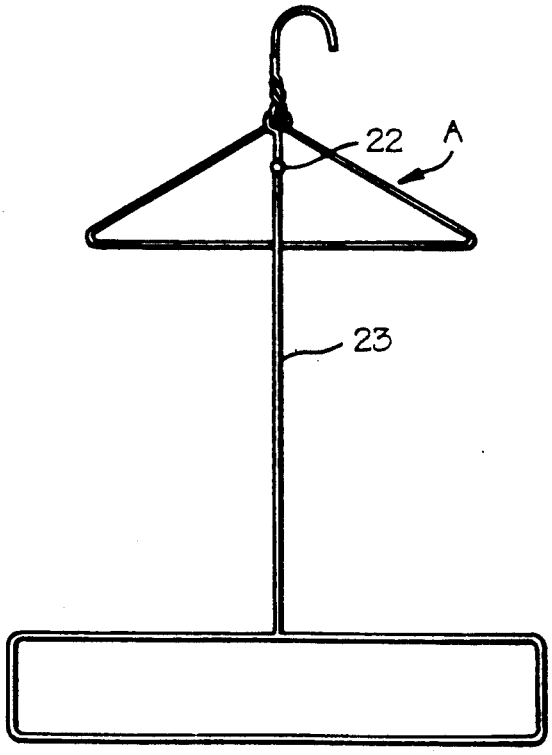
FIG. 3 shows an additional embodiment of the invention.

In a second embodiment of the present invention a swivel 22 was attached to a steel wire 23 shaped as shown in FIG. 3. In this embodiment the swivel is hung over the dress hanger on which the bridal gown is mounted and the bridal train is looped over the bottom rung of the train holder. It is readily recognized that other embodiments of the present invention are possible. In this regard, the use of the term bridal gown train holder is intended to generally encompass substantially any apparatus used to display a bridal gown in this manner.

To test the apparatus, bridal garments that had not received customer attention in six months were displayed using the preferred embodiment of the invention. The use of the train holder resulted in a more professional display, and all four garments received attention within eight hours and two were sold. It was also found that use of the bridal gown train holder reduced the amount of excess handling of the garments during customer viewings, thus reducing wrinkling of the garments. Storage space requirements were also reduced by almost fifty percent.

Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended, or to be construed, to limit the present invention or otherwise to exclude any such other embodiments, adaptations, variations, modifications and equivalent arrangements, the present invention being limited only by the claims appended hereto and the equivalents thereof.

I claim:

1. An apparatus for the display of bridal gowns in a bag such that the train is displayed without covering either the front or back of the bodice portion of the gown, said apparatus comprising in combination: a first garment hanger having a first suspending portion and a first body portion attached to the first suspending portion for supporting the bridal gown, and further comprising a second garment hanger having a second suspending portion and a second body portion attached to said second suspending portion for suspending the train of the gown, said second body portion having an enclosed opening therein, said second suspending portion attached to said first suspending portion, wherein a bridal gown is placed on said first garment hanger, with the train draped through said enclosed opening to support the train, and a garment bag containing said bridal gown, first garment hanger, and second garment hanger.

* * * * *